US005506055A

United States Patent [19]

Dorfman et al.

[11] Patent Number: 5,506,055

[45] **Date of Patent: *Apr. 9, 1996**

[54] BORON NITRIDE AND ALUMINUM THERMAL SPRAY POWDER

[75] Inventors: Mitchell R. Dorfman, Smithtown; Burton A. Kushner, Old Bethpage; Jorge E. Garcia, Farmingdale, all of N.Y.

[73] Assignee: Sulzer Metco (US) Inc., Westbury, N.Y.

[ * ] Notice: The term of this patent shall not extend beyond the expiration date of Pat. No. 5,049,450.

[21] Appl. No.: 272,706

[22] Filed: Jul. 8, 1994

[51] Int. Cl.[6] ..... B32B 15/02

[52] U.S. Cl. ..... 428/407; 428/699; 428/704

[58] Field of Search ..... 428/547, 551, 428/557, 560, 570, 403, 404, 407, 699, 704, 389

[56] References Cited

U.S. PATENT DOCUMENTS

| | | | |
|---|---|---|---|
| 3,322,515 | 5/1967 | Dittrich et al. | 428/570 |
| 3,617,358 | 11/1971 | Dittrich | 427/447 |
| 3,655,425 | 4/1972 | Longo et al. | 75/230 |
| 4,291,089 | 9/1981 | Adamovic | 428/325 |
| 4,593,007 | 6/1986 | Noviski | 501/105 |
| 4,645,716 | 2/1987 | Harrington et al. | 428/472 |
| 5,049,450 | 9/1991 | Dorfman et al. | 428/570 |
| 5,068,154 | 11/1991 | Mignani et al. | 428/446 |
| 5,070,591 | 12/1991 | Quick et al. | 29/527.1 |
| 5,122,182 | 6/1992 | Dorfman et al. | 75/252 |
| 5,126,205 | 6/1992 | Chon et al. | 428/405 |
| 5,196,471 | 3/1993 | Ramgaswamy | 524/406 |
| 5,302,450 | 4/1994 | Rao et al. | 428/357 |

OTHER PUBLICATIONS

"High Temperature Boron Nitride Abradable Materials" by W. J. Jarosinski et al., Union Carbide (1992).

*Primary Examiner*—D. S. Nakarani
*Assistant Examiner*—H. Thi Le
*Attorney, Agent, or Firm*—H. S. Ingham

[57] ABSTRACT

A composite thermal spray powder, for producing abradable coatings, is substantially in the form of clad particles each of which has a core particle of boron nitride and subparticles of aluminum-silicon alloy. The subparticles are bonded to the core particle with an polymeric binder.

4 Claims, No Drawings

BORON NITRIDE AND ALUMINUM THERMAL SPRAY POWDER

This invention relates to thermal spray powders and particularly to a composite thermal spray powder of boron nitride and aluminum-silicon alloy useful for producing abradable coatings.

BACKGROUND OF THE INVENTION

Thermal spraying, also known as flame spraying, involves the heat softening or melting of a heat fusible material such as metal or ceramic, and propelling the softened material in particulate form against a surface which is to be coated. The heated particles strike the surface where they are quenched and bonded thereto. A conventional thermal spray gun is used for the purpose of both heating and propelling the particles. In one type of thermal spray gun, the heat fusible material is supplied to the gun in powder form. Such powders are typically formed of small particles, e.g., between 100 mesh U.S. Standard screen size (149 microns) and about 2 microns.

A thermal spray gun normally utilizes a combustion or plasma flame to produce the heat for melting of the powder particles. In a powder-type combustion thermal spray gun, the carrier gas, which entrains and transports the powder, can be one of the combustion gases or an inert gas such as nitrogen, or it can be simply compressed air. In a plasma spray gun, the primary plasma gas is generally nitrogen or argon. Hydrogen or helium is usually added to the primary gas, and the carrier gas is generally the same as the primary plasma gas.

One form of powder for thermal spraying is a composite or aggregated powder in which very fine particles are agglomerated into powder particles of suitable size. Such powder produced by spray drying is disclosed in U.S. Pat. No. 3,617,358 (Dittrich) which also teaches various useful polymeric (organic) binders for the agglomerating. Agglomerated powder also may be made by blending a slurry of the fine powder constituents with a binder, and warming the mixture while continuing with the blending until a dried powder of the agglomerates is obtained. Generally the binder for the blending method may be the same as disclosed for spray drying.

U.S. Pat. No. 5,049,450 (Dorfman et al) teaches a homogeneous thermal spray powder produced by blending with a binder in a slurry, the powder being formed of subparticles of boron nitride and silicon-aluminum alloy. This patent is directed particularly to a powder for producing thermal spray coatings that are abradable such as for clearance control applications in gas turbine engines. The boron nitride is not meltable and so is carried into a coating by the meltable metal constituent and the binder in the thermal spray process. Excellent, abradable coatings are obtained, but certain improvements are desired.

Thus, although the latter patent teaches that the binder may be from 2% to 20%, in practice it has been found that a relatively high proportion of polymeric binder (at least 15%) is needed to help entrap the boron nitride in the coating. However, some of the higher amount of binder enters the coating and causes the as-sprayed coating to become too soft particularly after high temperature exposure. A lower binder content, even though producing good abradable coatings, results in relatively low deposit efficiency and higher hardness than desired.

If one of the constituents is formed of particles that are nearly the same size as the final powder, the composite is not homogeneous and, instead, comprises the larger particles as core particles with the finer second constituent bonded thereto by the binder. An example of such a clad powder is disclosed in U.S. Pat. No. 3,655,425 (Longo et al) wherein a constituent such as boron nitride is clad to nickel alloy core particles. The patent teaches that the core is only partially clad in order to expose core metal to the heat of the thermal spray process. Optionally, fine aluminum is added to the cladding for improvements that are speculated in the patent to be related to an exothermic reaction between the aluminum and the core metal.

Another powder for abradability comprises a core of a soft nonmetal such as Bentonite clad chemically with nickel alloy (without binder) as disclosed in U.S. Pat. No. 4,291,089 (Adamovic). U.S. Pat. No. 3,322,515 (Dittrich et al) teaches cladding metal core powders with aluminum subparticles using an polymeric binder.

U.S. Pat. No. 5,196,471 (Rangaswamy et al) discloses composite powders for thermal spraying of abradable coatings, in which the composite powders contain three components. One component is any of a number of metal or ceramic matrix materials, another component is a solid lubricant (such as a fluoride or boron nitride), and the third is a plastic. Although broad size ranges are disclosed for each component powder, specified as about 1 μm to about 150 μm, the only specific example (FIG. 1 of the patent) teaches fine particles of aluminum-silicon alloy and fine particles of $CaF_2$ imbedded in the surface of a larger polymide core particle.

The basic and generally contrary goals of an abradable coating are to attain both abradability and resistance to gas and particle erosion. Resistance to the corrosive environments of a gas turbine engine also is required. Although existing coatings have been quite successful for the purpose, the exacting requirements are difficult to achieve in total, and searches for improved abradable coatings continue.

SUMMARY OF THE INVENTION

Accordingly, an object of the invention is to provide an improved thermal spray powder useful for producing clearance control applications in gas turbine engines. A further object is to provide such a powder for producing coatings having improved abradability while maintaining erosion resistance. Another object is to provide such a powder for producing coatings with resistance to corrosion in a gas turbine engine environment. A specific object is to provide an improved composite powder of aluminum-silicon alloy and boron nitride. More specific objects are to provide such a boron nitride powder in a form that allows a reduced amount of polymeric binder for optimum coatings, and to provide such a powder for producing abradable coatings having a hardness that is maintained after exposure to high temperature.

The foregoing and other objects are achieved, at least in part, with a composite thermal spray powder that is substantially in the form of clad particles each of which comprises a core particle of boron nitride and subparticles of aluminum-silicon alloy. The subparticles are bonded to the core particle with a polymeric binder.

DETAILED DESCRIPTION OF THE INVENTION

Aluminum-silicon alloy utilized for the cladding particles should contain about 10% to 14% by weight of silicon, balance aluminum and incidental impurities (less than 1%).

Generally the boron nitride core material should be present in an amount of about 5% to 25%, and preferably 15% to 20%, by weight of the total of the boron nitride and the aluminum alloy. As the boron nitride has lower density than the aluminum alloy, the volume percentage of boron nitride is higher. The polymeric binder, measured as solids content in the powder, should be between 2% and 12% by weight of the total of the alloy and boron nitride, preferably 6% to 10%.

The boron nitride is in the conventional hexagonal BN form. The size of these core particles should be essentially between 44 μm and 210 μm, preferably distributed predominantly in the range 74 μm to 177 μm, preferably nearer the finer end. The aluminum alloy subparticles should be in the range of 1 μm and 44 μm. (These powder sizes correspond to convenient screen sizes except 1 μm which is about the smallest that can be measured by conventional optical means.)

The powder is produced by any conventional or desired method for making a polymerically bonded clad powder suitable for thermal spraying. The agglomerates should not be very friable so as not to break down during handling and feeding. A preferred method is agglomerating by stirring a slurry of the fine powder constituents with a binder, and warming the mixture while continuing with the blending until a dried powder of the agglomerates is obtained. The polymeric binder may be conventional, for example selected from those set forth in the aforementioned patents. The amount of liquid binder introduced into the initial slurry is selected to achieve the proper percentage of polymeric solids in the final dried agglomerated powder. One or more additives to the slurry such as a neutralizer as taught in any of the foregoing references the may be advantageous. Although the powder is substantially formed of boron nitride cores with cladding of aluminum alloy subparticles, it will be appreciate that some of the powder grains will be agglomerates of smaller boron nitride particles with the alloy subparticles.

EXAMPLE

A composite powder was manufactured by agglomerating a core powder of 17% wt. % boron nitride (BN) with fine powder of aluminum-12 wt. % silicon alloy. The respective sizes of the boron nitride and alloy powders were 74 μm to 177 μm and 1 μm to 44 μm. Table 1 shows size distributions for these powders.

TABLE 1

| | Percent Exceeding | |
|---|---|---|
| Microns | BN | Alloy |
| 176 | 30.4 | 0 |
| 124 | 62.1 | 1.3 |
| 88 | 83.3 | 6.2 |
| 62 | — | 15.7 |
| 44 | 93.9 | 28.2 |
| 22 | 96.1 | 62.2 |
| 11 | — | 83.7 |

These powder ingredients were premixed for 30 minutes, then a polymeric binder (UCAR Latex 879) was added to this mixture with distilled water and acetic acid to neutralize the slurry. The proportions were selected according to Table 2.

TABLE 2

| | |
|---|---|
| Alloy | 36 gm |
| BN | 9 gm |
| Binder | 9 gm |
| Water | 9 gm |

The container was warmed to about 135° C., and stir blending was continued until the slurry and binder were dried and a composite powder was formed with approximately 8% by weight of polymeric solids. After the powder was manufactured it was top screened at 210 μm (70 mesh) and bottom screened at 44 μm (325 mesh).

The powder was sprayed with a Metco Type 9MB plasma spray gun using a GH nozzle and a #1 powder port. Spray parameters were argon primary gas at 7 kg/cm$^2$ pressure and 96 l/min flow rate, hydrogen secondary gas at 3.5 kg/cm$^2$ and flow as required to maintain about 80 volts (about 10 l/min), 500 amperes, spray rate 3.6 kg/hr, spray distance 13 cm. These parameters were the same as recommended and used for the aforementioned agglomerated powder made in accordance with the example set forth in the aforementioned U.S. Pat. No. 5,049,450. Table 3 compares powder chemistries and some coating properties for the prior agglomerated and present (invention) clad powders.

TABLE 3

| | Agglomerated | Clad |
|---|---|---|
| Powder Chemistry | | |
| Boron nitride (1) | 10–12% | 16–18% |
| Polymeric solids (1) | 15–17% | 8–10% |
| Silicon (1) | 8–10% | 8–10% |
| Aluminum | Balance | Balance |
| Coating Properties | | |
| Non-metallic (2) | 35–40% | 30–35% |
| Porosity (2) | 2–4% | 2–4% |
| Polymeric solids (2) | 4–8% | <4% |
| Metal phase | Balance | Balance |
| Hardness (R15y) | 50–60 | 60–70 |

(1) Weight percents
(2) Volume percents

Compared to the agglomerated powder, the clad powder coating of the present invention contained significantly less polymeric binder. The clad powder coating had higher hardness which should provide improved erosion resistance. Microstructures revealed relatively coarse boron nitride imbedded in aluminum alloy matrix. Hardness measurements showed the clad powder coating to be harder with less densification (compression) of the top surface.

While the invention has been described above in detail with reference to specific embodiments, various changes and modifications which fall within the spirit of the invention and scope of the appended claims will become apparent to those skilled in this art. The invention is therefore only intended to be limited by the appended claims or their equivalents.

We claim:

1. A composite thermal spray powder substantially in the form of clad particles each of which comprises a core particle of hexagonal boron nitride and subparticles of aluminum-silicon alloy, bonded to the core particle with a polymeric binder, the alloy containing about 10% to 14% silicon by weight of the alloy, the balance of the alloy being aluminum and less than 1% incidental impurities, the boron nitride being present at about 5% to 25% by weight of the total of the boron nitride and the alloy, the core particles having a size predominently between 74 μm and 177 μm, and the alloy subparticles having a size between 1 μm and 44 μm.

2. The composite powder according to claim 1 wherein the boron nitride is present at 15% to 20% by weight of the total of the boron nitride and the alloy.

3. The composite powder according to claim 1 wherein the polymeric binder is present between 6% and 12% by weight polymeric solids based on the total weight of the boron nitride and the alloy.

4. A composite thermal spray powder substantially in the form of clad particles each of which comprises a core particle of hexagonal boron nitride and subparticles of aluminum-silicon alloy, bonded to the core particle with a polymeric binder, the alloy containing about 10% to 14% silicon by weight of the alloy, the balance of the alloy being aluminum and less than 1% incidental impurities, the boron nitride being present at about 15% to 20% by weight of the total of the boron nitride and the alloy, the polymeric binder being present between 6% and 12% by weight polymeric solids based on the total weight of the boron nitride and the alloy, the core particles having a size between 74 μm and 177 μm, and the alloy subparticles having a size between 1 μm and 44 μm.

* * * * *